US006446919B1

(12) United States Patent
Tsui

(10) Patent No.: US 6,446,919 B1
(45) Date of Patent: Sep. 10, 2002

(54) SIZE-ADJUSTABLE DETACHABLE PORTABLE GARBAGE BAG RACK

(76) Inventor: Rouh-Farm Tsui, 3F, No. 81, Lane 11, Kuang Fu N. Road, Taipei (TW)

( * ) Notice: Subject to any disclaimer, the term of this patent is extended or adjusted under 35 U.S.C. 154(b) by 0 days.

(21) Appl. No.: 09/930,952

(22) Filed: Aug. 17, 2001

(51) Int. Cl.[7] ..... B65B 67/04
(52) U.S. Cl. ..... 248/100; 248/97
(58) Field of Search ..... 248/95, 97, 99, 248/100, 101; 403/326, 327, 328, 329

(56) References Cited

U.S. PATENT DOCUMENTS

| | | | | | |
|---|---|---|---|---|---|
| 3,633,859 | A | * | 1/1972 | Vosbikian | 248/97 |
| 4,759,518 | A | * | 7/1988 | Yardas | 248/97 |
| 4,759,519 | A | * | 7/1988 | Cheng | 248/99 |
| RE33,842 | E | * | 3/1992 | Ebentheuer | 248/97 |
| 5,180,126 | A | * | 1/1993 | Bennett | 248/99 |
| 5,263,672 | A | * | 11/1993 | He | 248/97 |
| 5,267,711 | A | * | 12/1993 | Perreault | 248/101 |
| 6,199,802 | B1 | * | 3/2001 | Scheibe, Sr. | 248/97 |
| 6,237,878 | B1 | * | 5/2001 | Nelson | 248/99 |
| 6,293,505 | B1 | * | 9/2001 | Fan | 248/99 |

* cited by examiner

*Primary Examiner*—Anita King
*Assistant Examiner*—Kofi Schulterbrandt
(74) *Attorney, Agent, or Firm*—Donald C. Casey, Esq.

(57) ABSTRACT

A size-adjustable detachable portable garbage bag rack for holding a garbage bag to collect garbage is constructed to include an adjustable top frame unit formed of four main frame bars and four auxiliary frame bars, an adjustable bottom frame unit formed of four main frame bars and four auxiliary frame bars, and a support frame unit formed of four detachable support frame bars selectively connected between the top frame unit and the bottom frame unit subject to the set size of the top frame unit and the bottom frame unit.

1 Claim, 12 Drawing Sheets

SIZE-ADJUSTABLE DETACHABLE PORTABLE GARBAGE BAG RACK

BACKGROUND OF THE INVENTION

The present invention relates to a garbage bag rack adapted to hold a garbage bag for collecting garbage and, more particularly, to a size-adjustable detachable portable garbage bag rack that can be adjusted to fit different garbage bags of different sizes. When not in use, the size-adjustable detachable portable garbage bag rack can be arranged in a detached manner and carried in a carton or carrying bag.

Regular dustbins or garbage bag racks are commonly made in a unitary piece. These dustbins or garbage bag racks occupy much storage space when not in use because they are not detachable. Further, regular dustbins or garbage bag racks fit a particular size of garbage bags only. Different sizes of garbage bags shall be used with different sizes of dustbins or garbage bag racks.

SUMMARY OF THE INVENTION

The present invention has been accomplished under the circumstances in view. It is one object of the present invention to provide a garbage bag rack, which can be adjusted horizontally as well as vertically to fit different sizes of garbage bags. It is another object of the present invention to provide a garbage bag rack, which is detachable. It is still another object of the present invention to provide a garbage bag rack, which has hanger means for hanging a garbage bag for collecting garbage. It is still another object of the present invention to provide a garbage bag rack, which has clamp means for securing a garbage bag for collecting garbage. According to one aspect of the present invention, the size-adjustable detachable portable garbage bag rack comprises an adjustable top frame unit formed of four main frame bars and four auxiliary frame bars, an adjustable bottom frame unit formed of four main frame bars and four auxiliary frame bars, and a support frame unit formed of four detachable support frame bars selectively connected between the top frame unit and the bottom frame unit subject to the set size of the top frame unit and the bottom frame unit. According to another aspect of the present invention, the auxiliary frame bars of the top frame unit can be respectively axially moved in the main frame bars of top frame unit to adjust the size of the top frame unit and then set in the adjusted position, the auxiliary frame bars of the bottom frame unit can be respectively axially moved in the main frame bars of top frame unit to adjust the size of the bottom frame unit and then set in the adjusted position, and the support frame bars of the support frame unit can be selectively connected between bottom screw rods of the top frame unit and top screw rods of the bottom frame unit subject to the set size of the top frame unit and the bottom frame unit. According to another aspect of the present invention, the main frame bars of the top frame unit have hanging hooks for hanging a garbage bag. According to still another aspect of the present invention, C-shaped clamps are provided for securing a garbage bag to the support frame bars of the support frame unit.

DETAILED DESCRIPTION OF THE PREFERRED EMBODIMENT

Figure 1:
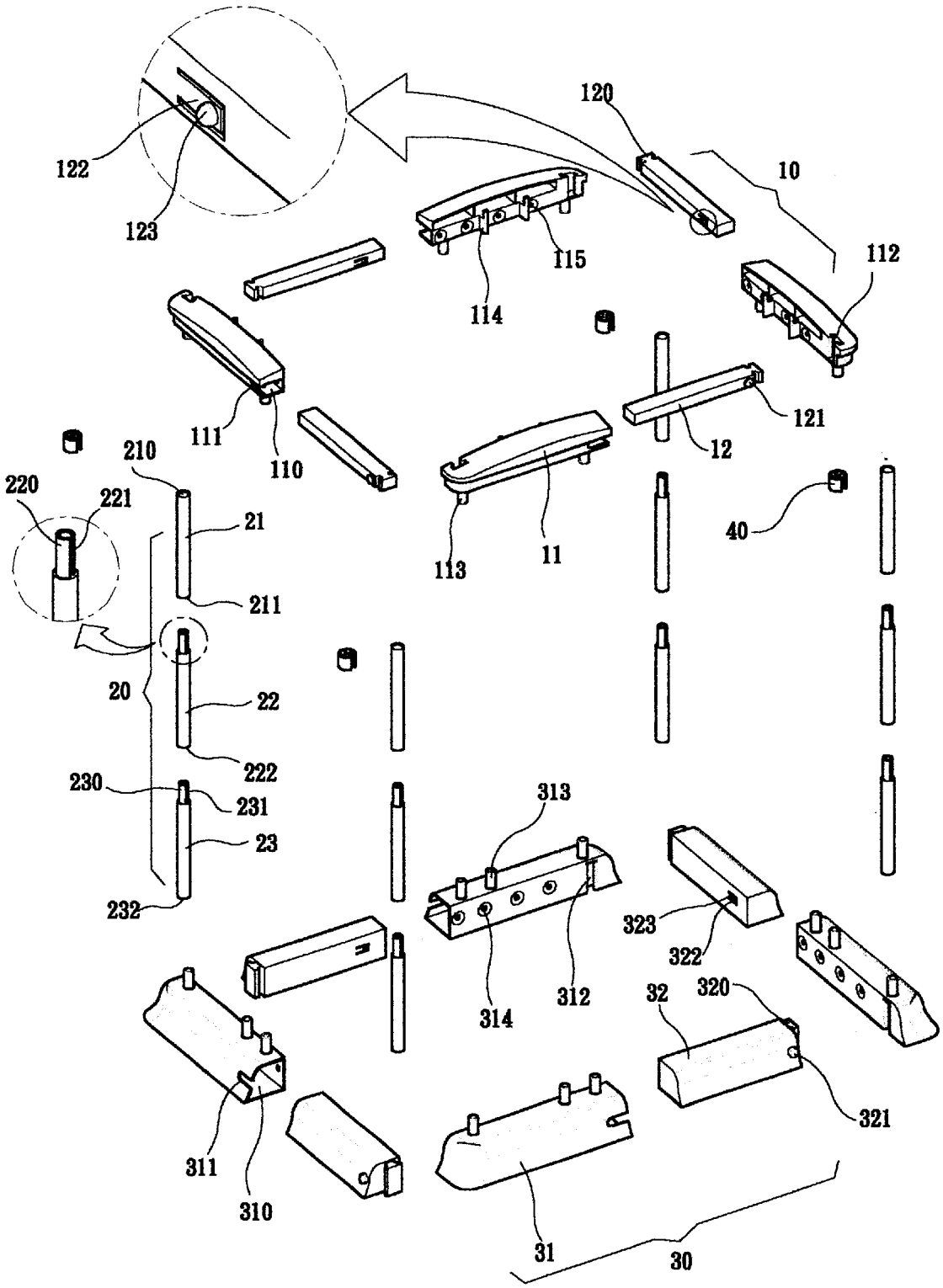
FIG. 1 is an exploded view of a garbage bag rack according to the present invention.

Referring to FIG. 1*m* a garbage bag rack in accordance with the present invention is comprised of a top frame unit 10, a bottom frame unit 30, and a support frame unit 20 connected between the top frame unit 10 and the bottom frame unit 30.

The top frame unit 10 is comprised of four main frame bars 11 and four auxiliary frame bars 12. The mainframe bars 11 each comprise a plug hole 110 axially disposed at one end thereof, a sliding slot 111 in one sidewall of the plug hole 110, a T-shaped coupling hole 112 disposed in one side of the other end thereof, two bottom screw rods 113 respectively perpendicularly extended from the bottom sidewall thereof near the two distal ends, a plurality of hanging hooks 114 provided at one peripheral sidewall, and a plurality, for example, four longitudinally spaced locating holes 115. The auxiliary frame bars 12 each comprise a coupling rod 120 of T-shaped profile axially extended from one end thereof and adapted to engage the plug hole 112 of one main frame bar 11, a stop block 121 disposed at one end adjacent to the coupling rod 120 for sliding in the sliding slot 111 of one main frame bar 11, and a springy strip 122 cut from a part of one sidewall thereof remote from the coupling rod 120. The spring strip 122 has a fixed end formed integral with the respective auxiliary frame bars 12, and a free end terminating in a raised retaining portion 123 for positioning in one of the locating holes 115 of one main frame bar 11.

The support frame unit 20 is comprised of four support frame bars, each support frame bar comprised of a first frame tube 21, a second frame tube 22, and a third frame tube 23. The first frame tube 21 has a screw hole 210 in one end thereof for threading onto one bottom screw rod 113 of one main frame bar 11 of the top frame unit 10, and a plug hole 211 in the other end thereof for the mounting of the second frame tube 22. The second frame tube 22 has a split coupling rod 220 axially extended from one end thereof for press-fitting into the plug hole 211 of the first frame tube 21, and a plug hole 222 in the other end thereof. The split coupling rod 220 has a longitudinal split 221. The third frame tube 23 has a split coupling rod 230 axially extended from one end thereof for press-fitting into the plug hole 222 of the second frame tube 22, and a screw hole 232 in the other end thereof. The split coupling rod 230 has a longitudinal split 231.

The bottom frame unit 30 is comprised of four main frame bars 31 and four auxiliary frame bars 32. The main frame bars 31 each comprise a plug hole 310 axially disposed at one end thereof, a sliding slot 311 in one sidewall of the plug hole 310, a T-shaped coupling hole 312 disposed in one side of the other end thereof, three top screw rods 313 respectively perpendicularly extended from the top sidewall thereof, and four locating holes 314 longitudinally spaced at the back sidewall thereof. The auxiliary frame bars 32 each comprise a coupling rod 320 axially extended from one end thereof and adapted to engage the plug hole 312 of one main frame bar 31, a stop block 321 disposed at one end adjacent to the coupling rod 320 for sliding in the sliding slot 311 of one main frame bar 31, and a springy strip 322 cut from a part of one sidewall thereof remote from the coupling rod320. The spring strip 322 has a fixed end formed integral with the respective auxiliary frame bars 32, and a free end terminating in a raised retaining portion 323 for positioning in one of the locating holes 314 of one main frame bar 31.

The connection between the respective screw rods 113;313 and the respective screw holes 210;232, the connection between the respective coupling rods 120;320 and the respective T-shaped coupling holes 112;312, the connection between the respective raised retaining portions 123;323 of the respective sp5ringy strips 122;322 and the respective locating holes 114;314, and the coupling between the respective stop blocks 121;321 and the respective sliding slots 111;311 set up the garbage bag rack.

Figure 2A:
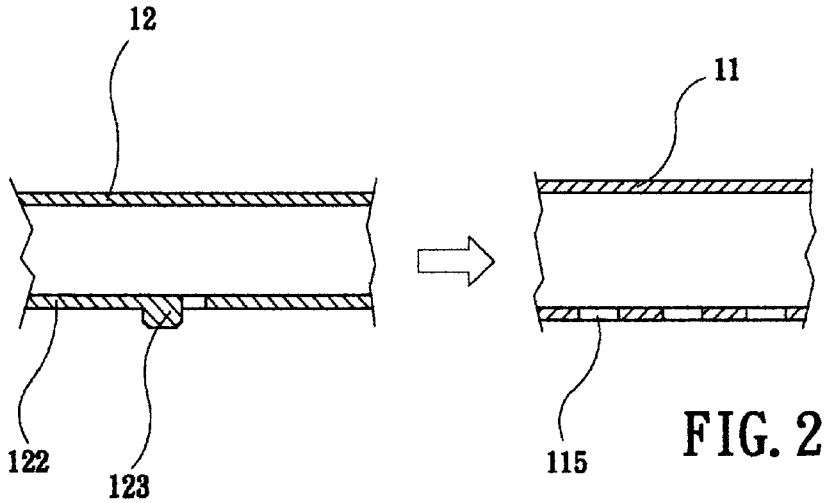
FIGS. 2A, 2B and 2C are sectional views showing the actions of the connection between the main frame bar and the auxiliary frame bar according to the present invention.
Figure 2:
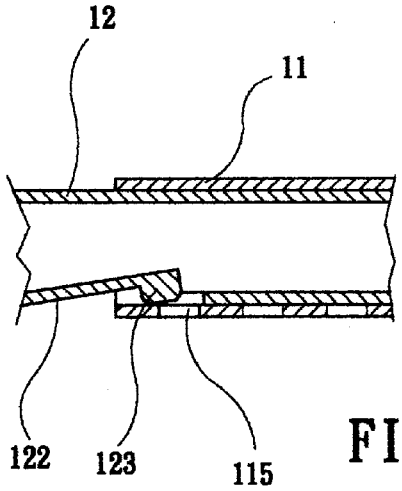
Figure 2:
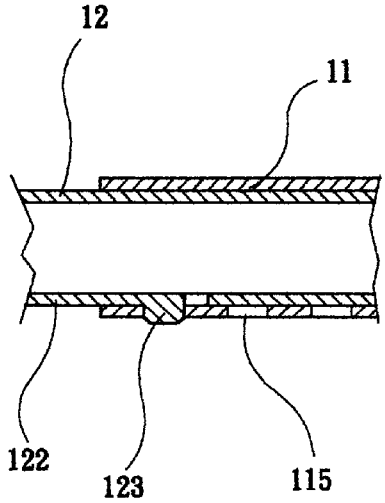
Figure 3:
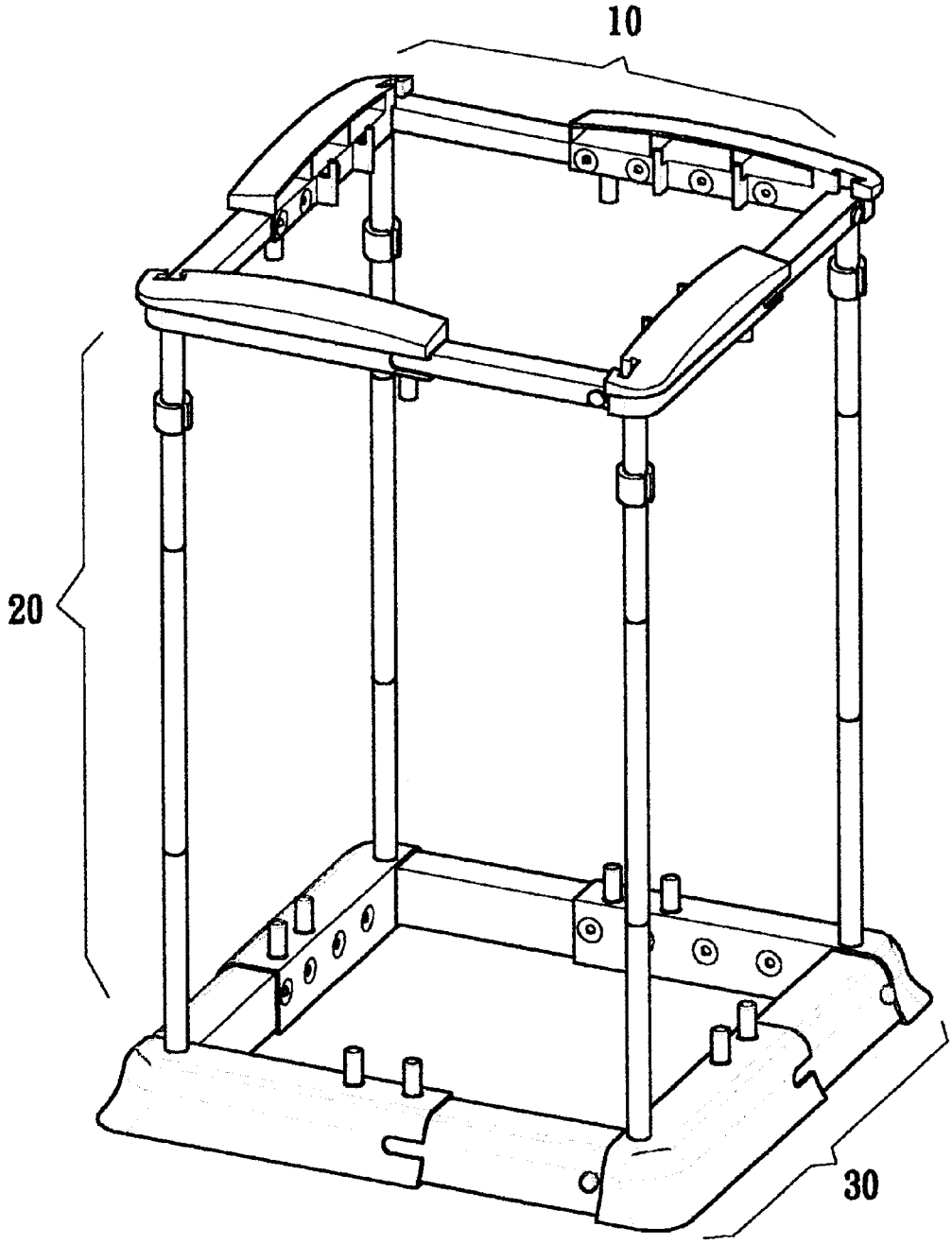
FIG. 3 is an elevational view of the garbage bag rack according to the present invention.

The connection between the main frame bar 11 and the corresponding auxiliary frame bar 12 of the top frame unit 10 is outlined hereinafter with reference to FIGS. 2A, 2B, and 2C. Before the insertion of the auxiliary frame bar 12 into the plug hole 110 of the main frame bar 11, the springy strip 122 is suspended in the respective sidewall of the auxiliary frame bar 12. When inserting the auxiliary frame bar 12 into the plug hole 110 of the main frame bar 11, as shown in FIG. 2B, the springy strip 122 is forced inwards by the inside wall of the main frame bar 11. After the auxiliary frame bar 12 has been inserted into the plug hole 110 of the main frame bar 11 and set into position, as shown in FIG. 2C, the raised retaining portion 123 of the springy strip 122 is forced into engagement with one locating hole 115 of the main frame bar 11. The combined length of the main frame bar 11 and the auxiliary frame bar 12 can be adjusted by shifting the engagement position of the raised retaining portion 123 of the springy strip 122 from one locating hole 115 of the main frame bar 11 to another. FIG. 3 shows the top frame unit 10 set in the maximum dimensions. Further, the connection between the main frame bar 31 and the corresponding auxiliary frame bar 32 of the bottom frame unit 30 is similar to the top frame unit 10.

Figure 4A:
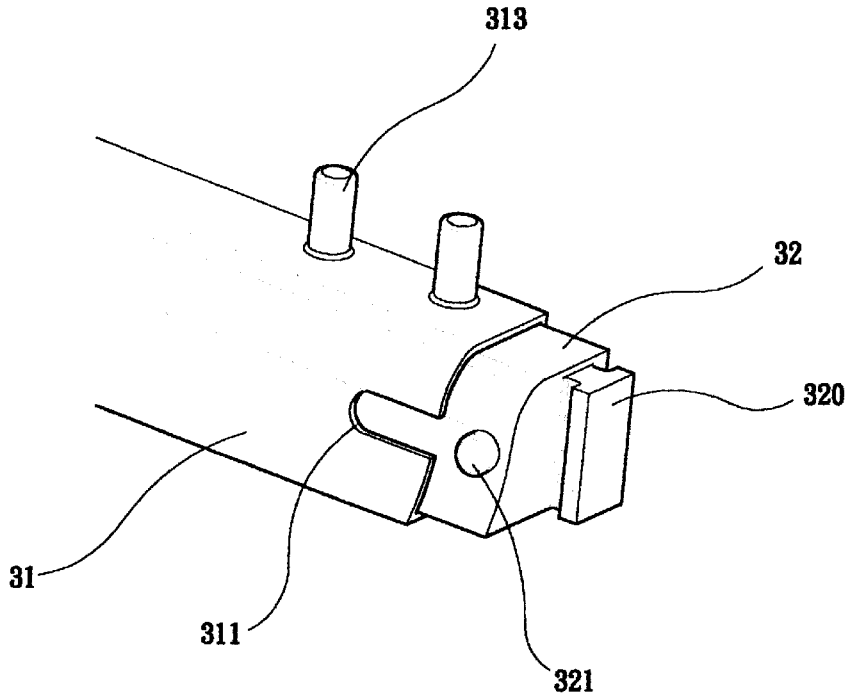
FIG. 4A illustrates the auxiliary frame bar of the bottom frame unit inserted into the corresponding main frame bar according to the present invention.
Figure 4B:
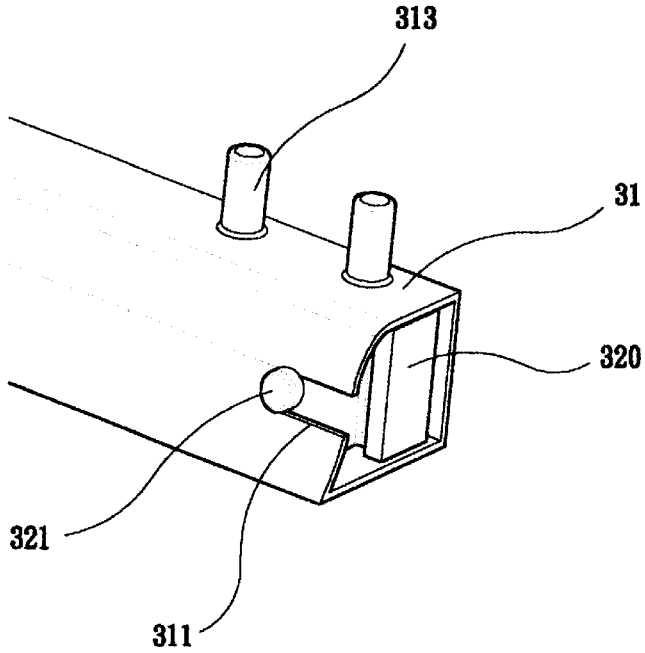
FIG. 4B is similar to FIG. 4A but showing the stop block of the auxiliary frame bar stopped at the inner close end of the sliding slot of the main frame bar.

Referring to FIGS. 4A and 4B, when receiving the auxiliary frame bar 32 in the main frame bar 31, the stop block 321 of the auxiliary frame bar 32 is forced into the sliding slot 311 of the main frame bar 31 and then stopped at the inner close end of the sliding slot 311. Through the stop block 321, the auxiliary frame bar 32 can easily be pulled out of the main frame bar 31.

Figure 5:
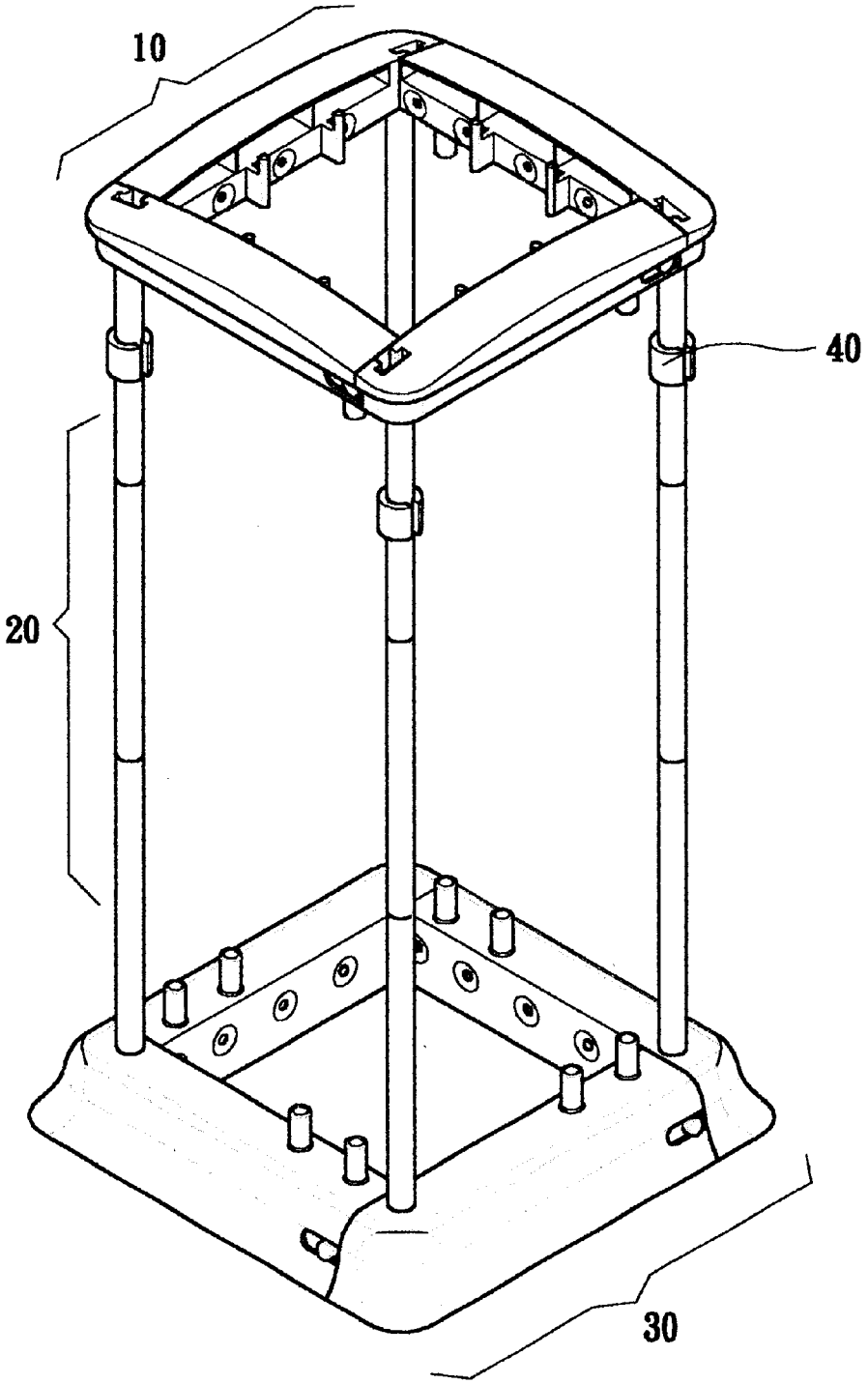
FIG. 5A shows the garbage bag rack set in one operative status.
FIG. 5B shows the garbage bag rack set in another operative status.
Figure 5B:
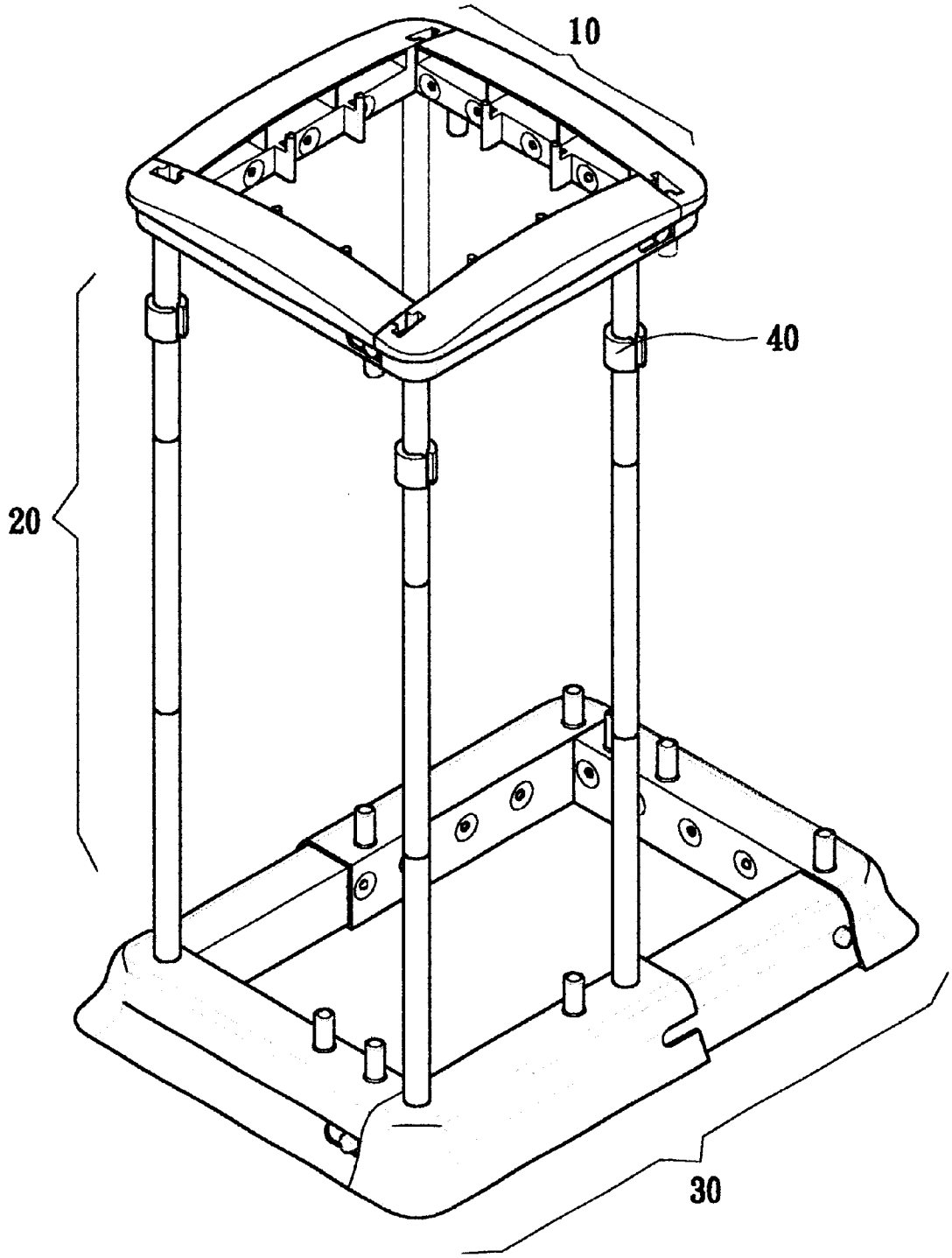

Referring to FIGS. 5A and 5B and FIG. 1 again, the support frame unit 20 can be selectively fastened to the bottom screw rods 113 of the main frame bars 11 of the top frame unit 10 and the top screw rods 313 of the main frame bars 31 of the bottom frame unit 30 subject to the size of the garbage bag rack to be set.

Figure 8A:
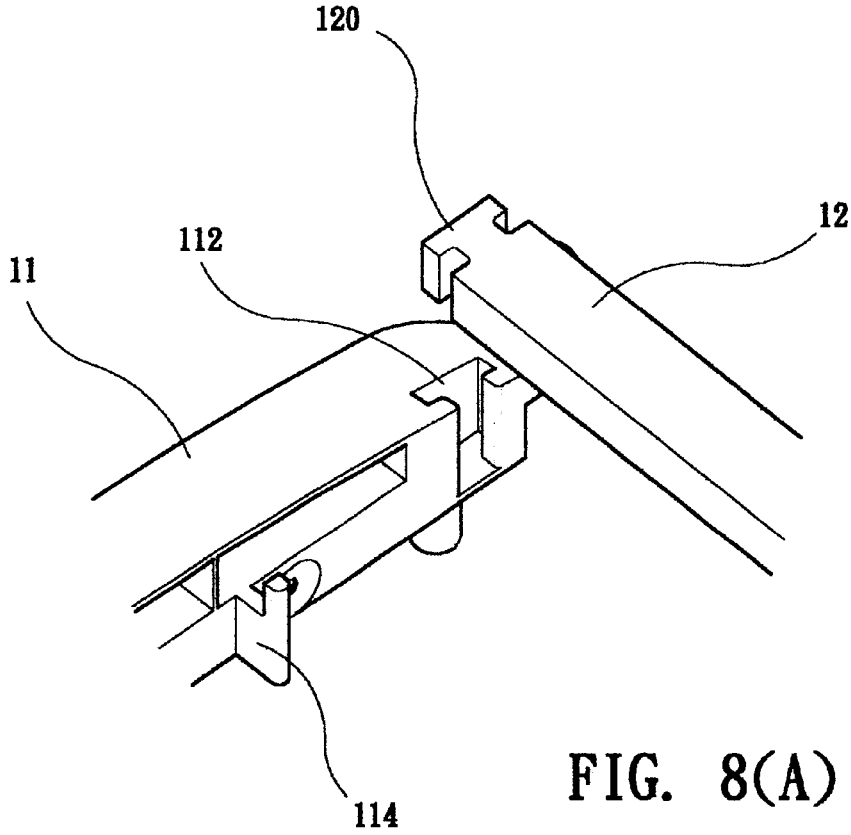
FIG. 8A illustrates the relationship between the coupling rod of one auxiliary frame bar of the top frame unit and the T-shaped coupling groove of one main frame bar of the top frame unit according to the present invention.
Figure 8B:
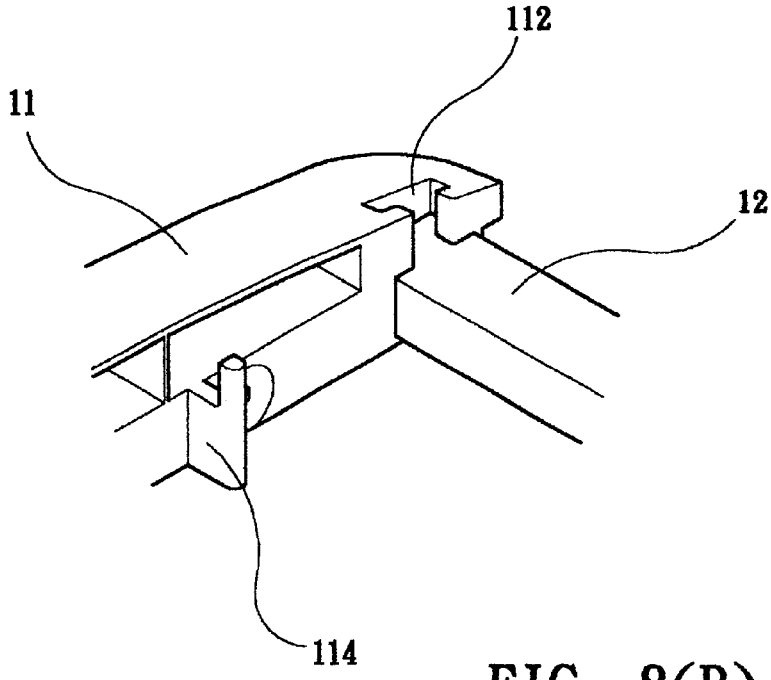
FIG. 8B is similar to FIG. 8A but showing the coupling rod of the auxiliary frame bar engaged into the T-shaped coupling groove of the main frame bar.

Referring to FIGS. 8A and 8B and FIG. 1 again, the coupling rod 120 of the auxiliary frame bar 12 is forced into engagement with the T-shaped coupling hole 112 of the main frame bar 11. This engagement enables the top frame unit 10 to bear a heavy load.

Figure 6:
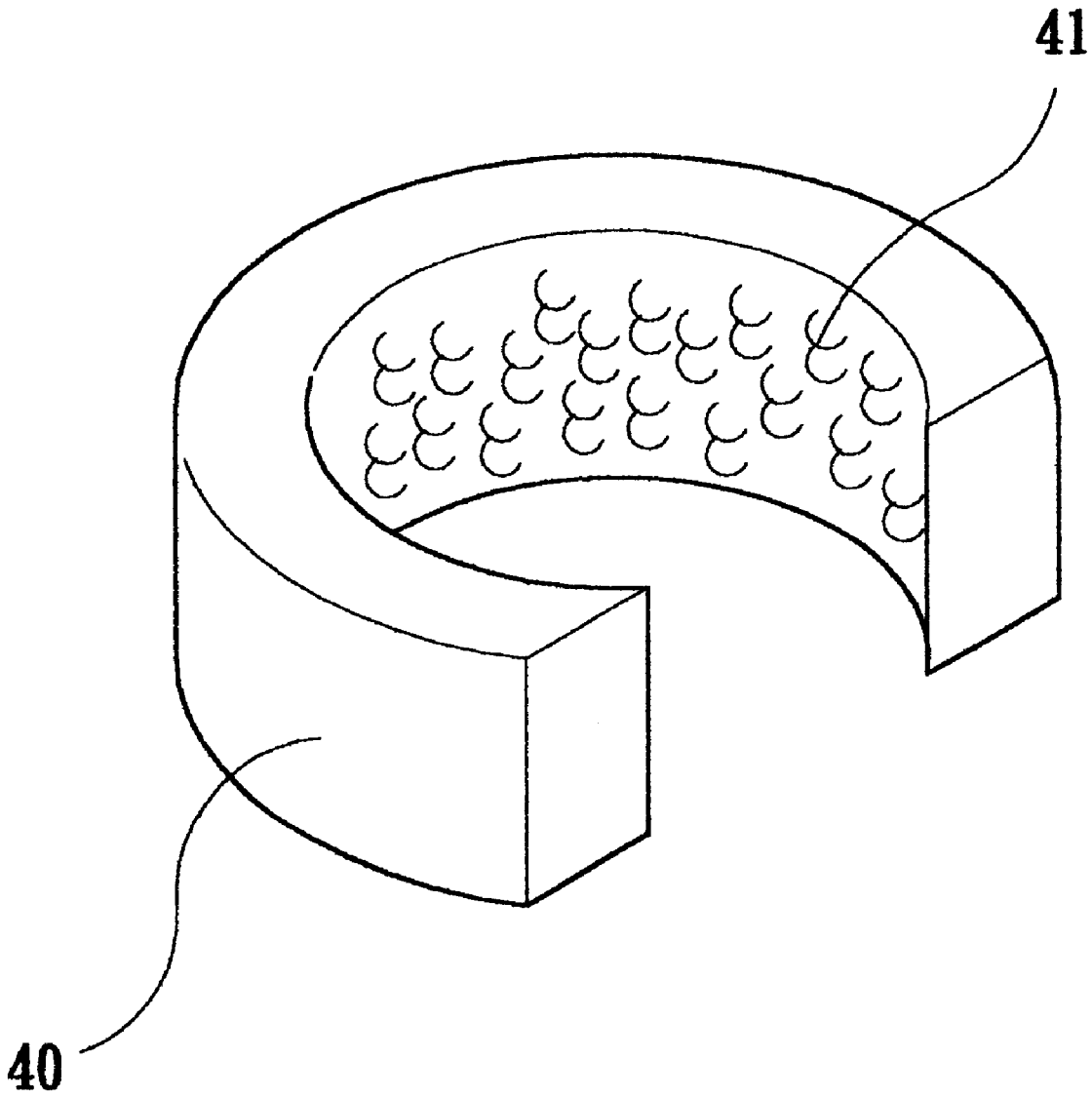
FIG. 6 is an elevational view of a C-shaped garbage bag clamp according to the present invention.

Referring to FIG. 6 and FIGS. 1 and 5A again, C-shaped garbage bag clamps 40 are respectively fastened to the support frame unit 20 and adapted to hold a garbage bag in the garbage bag rack. The C-shaped garbage bag clamps 40 each have a grained inner engagement wall 41 adapted to secure a garbage bag to the first frame tube 21 of each support frame bar of the support frame unit 20.

Figure 9A:
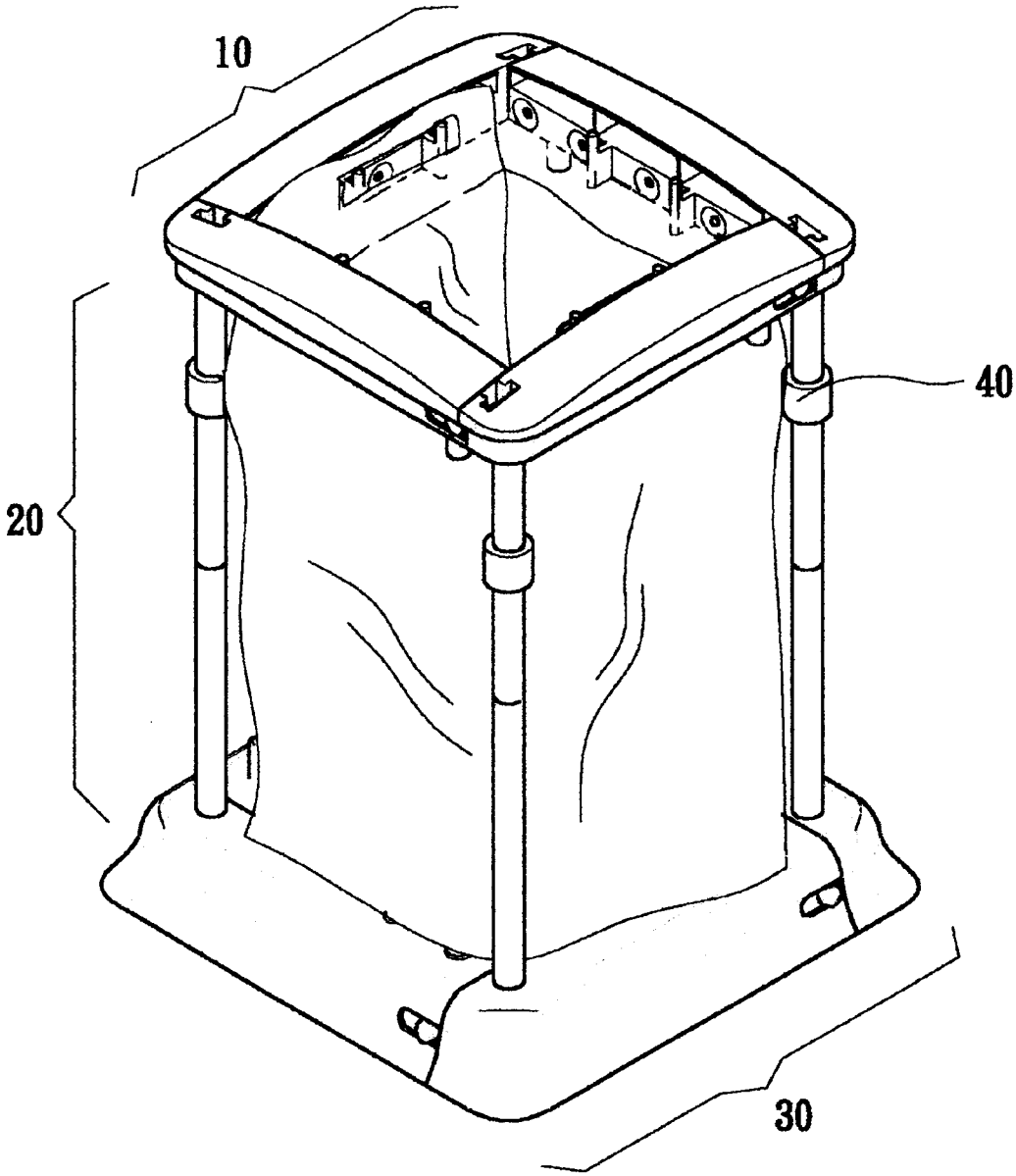
FIG. 9A shows an application example of the present invention.
Figure 9B:
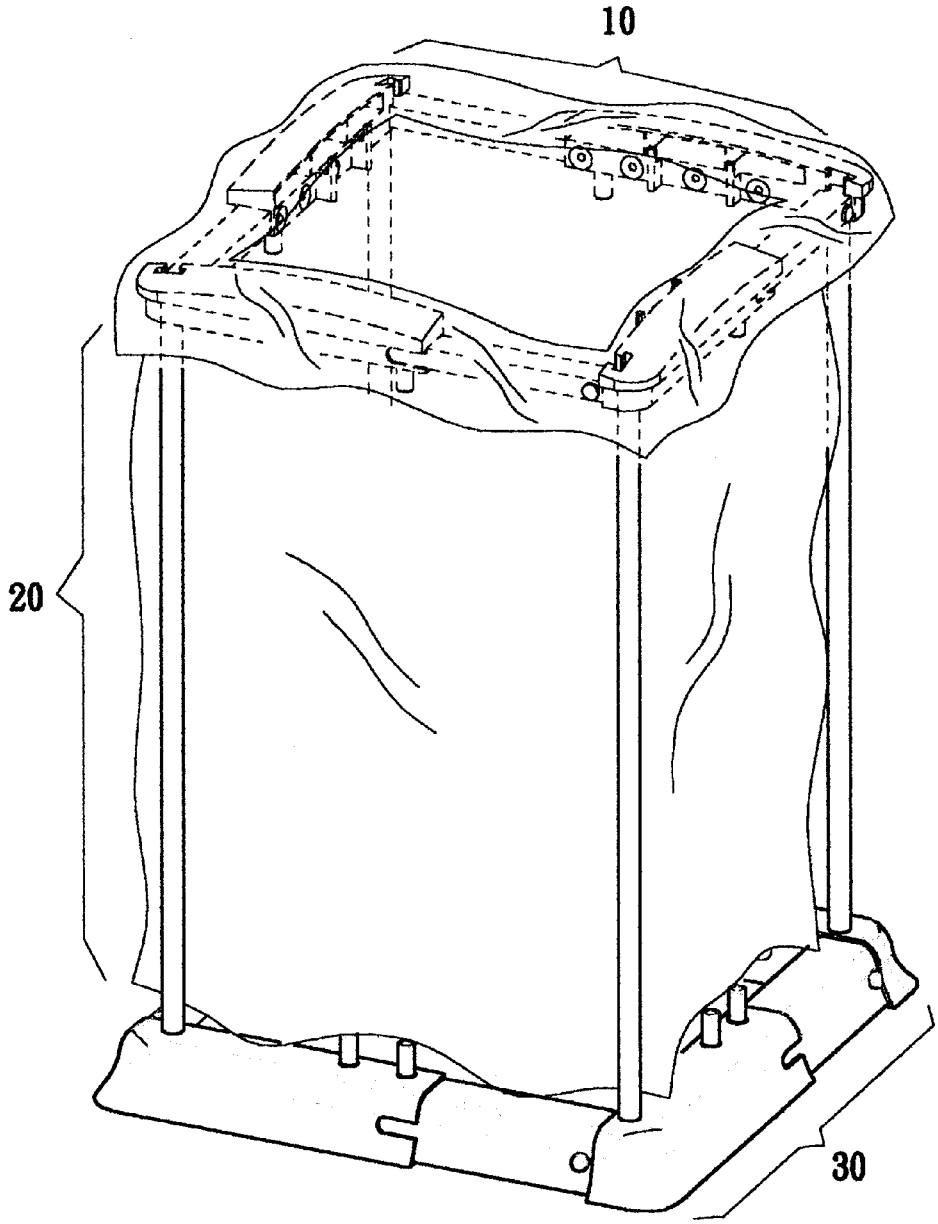
FIG. 9B shows another application example of the present invention.

Referring to FIG. 9A and FIG. 1 again, the open side of the garbage bag can be hung on the hanging hooks 114 of the main frame bars 11 of the top frame unit 10.

Figure 7A:
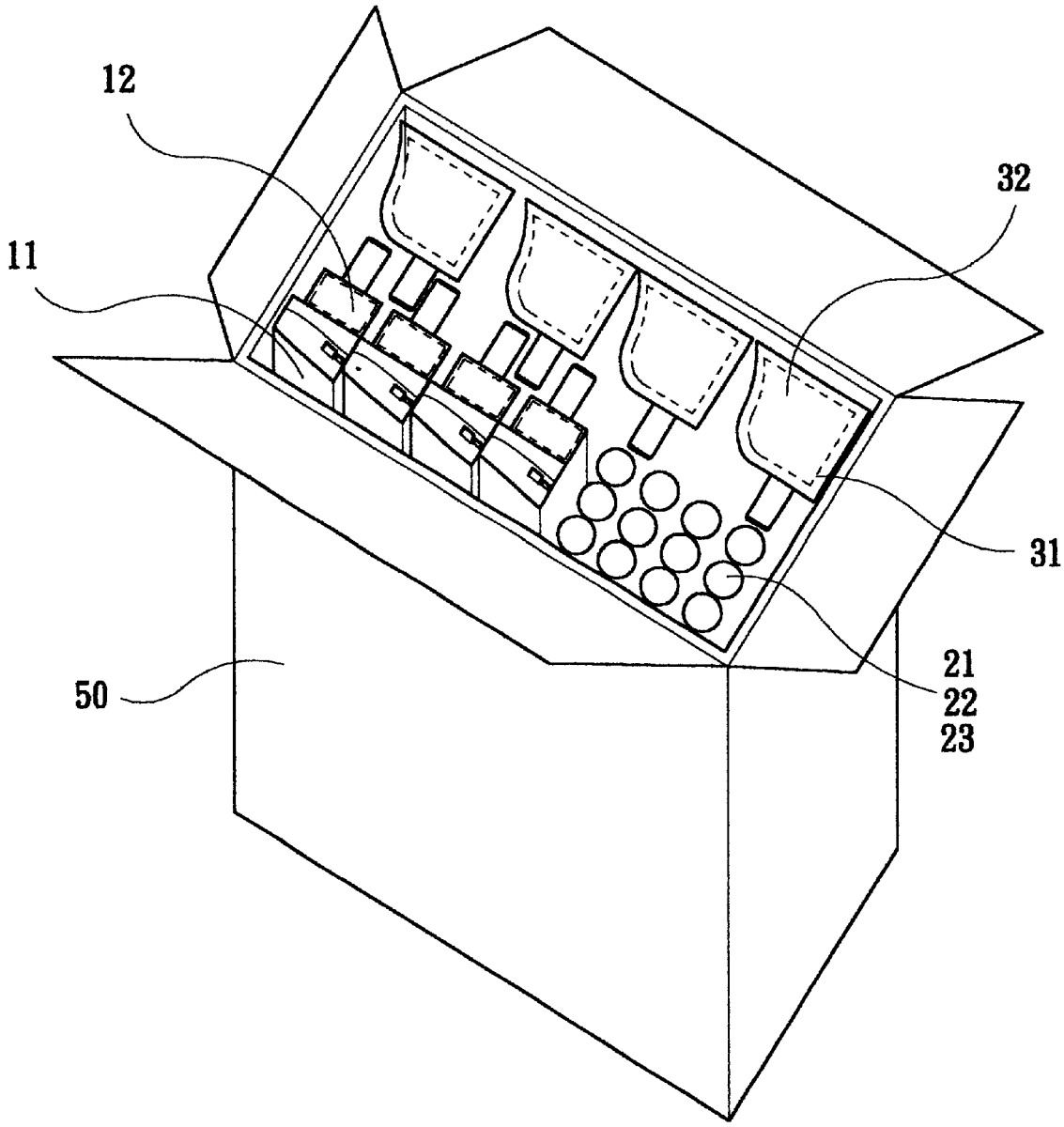
FIG. 7A shows the garbage bag rack detached and packed in a carton according to the present invention.
Figure 7B:
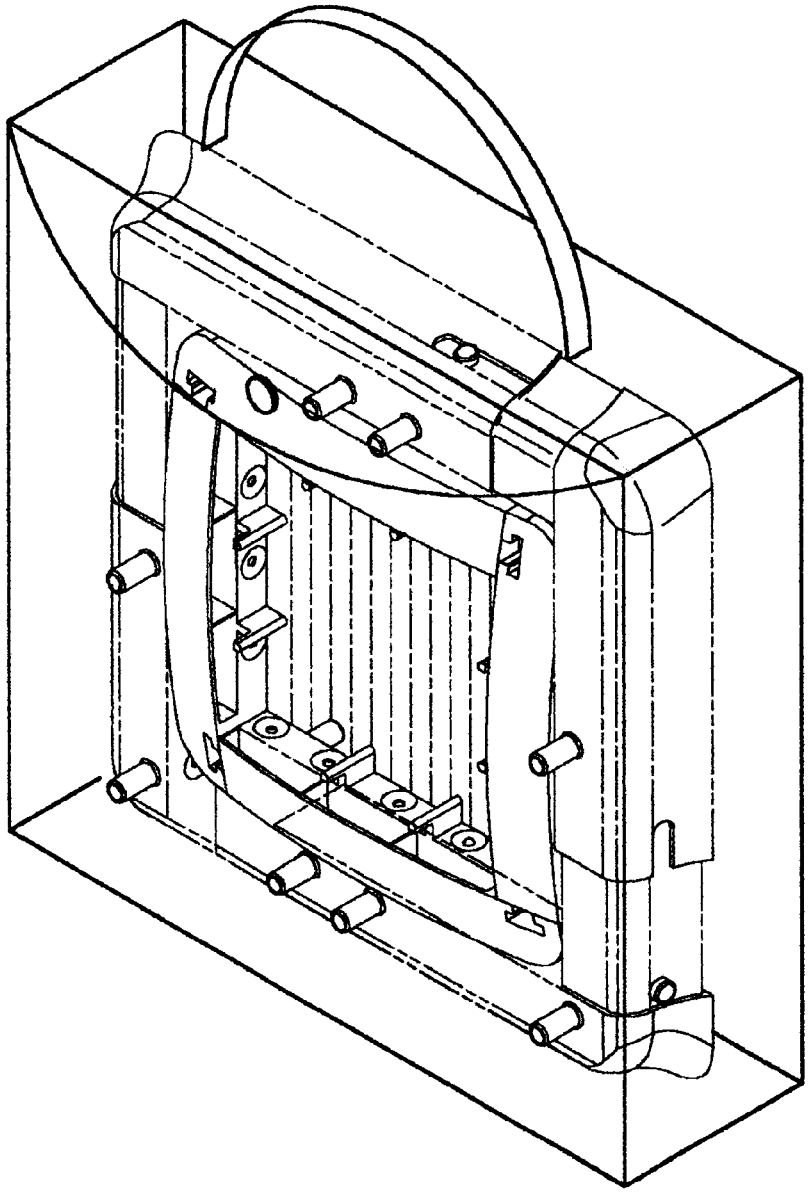
FIG. 7B shows the garbage bag rack detached and packed in a carrying bag according to the present invention.

Referring to FIGS. 7A and 7B, when detached, the detached parts of the garbage bag rack can be packed in a carton 50 as shown in FIG. 7A, or a carrying bag 60 as shown in FIG. 7B.

A prototype of garbage bag rack has been constructed with the features of FIGS. 1~9. The garbage bag rack functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A garbage bag rack comprising:

a top frame unit, said top frame unit comprising four main frame bars and four auxiliary frame bars, each main-frame bars of said top frame unit comprising a first end, a second end, a plug hole axially disposed in said first end, a sliding slot in one sidewall of said first end, a T-shaped coupling hole in one side of said second end, two bottom screw rods respectively perpendicularly extended from a bottom sidewall thereof, a plurality of hanging hooks provided at one peripheral sidewall thereof, and a plurality of longitudinally spaced locating holes, each auxiliary frame bar of said top frame unit comprising a first end, a second end, a coupling rod axially extended from the first end and adapted to engage the plug hole of one main frame bar of said top frame unit, a stop block disposed at the first end for coupling to the sliding slot of one main frame bar of said top frame unit, and a springy strip cut from a part of one sidewall thereof near the second end, the spring strip of each auxiliary frame bar of said top frame unit having a free end terminating in a raised retaining portion for selectively positioning in one of the locating holes of one main frame bar of said top frame unit;

a support frame unit, said support frame unit comprising four support frame bars, said supporting frame bars each comprised of a first frame tube, a second frame tube, and a third frame tube respectively connected in a line, said first frame tube having screw hole in one end thereof for threading onto one bottom screw rod of one main frame bar of said top frame unit and a plug hole in an opposite end thereof for the mounting of said second frame tube, said second frame tube having a split coupling rod axially extended from one end thereof for press-fitting into the plug hole of said first frame tube and a plug hole in an opposite end thereof, said third frame tube having a split coupling rod axially extended from one end thereof for press-fitting into the plug hole of said second frame tube and a screw hole in an opposite end thereof;

a bottom frame unit, said bottom frame unit comprising four main frame bars and four auxiliary frame bars, each main frame bar of said bottom frame unit comprising a first end, a second end, a plug hole axially disposed in the first end, a sliding slot in one sidewall of the first end, a T-shaped coupling hole disposed in one side of the second end, three top screw rods respectively perpendicularly extended from the top sidewall thereof for selectively fastening to the screw hole of the third frame tube of each of the support frame bars of said support frame unit, and four locating holes longitudinally spaced at a back sidewall thereof, each auxiliary frame bar of said bottom frame unit comprising a first end, a second end, a coupling rod axially extended from the first end and adapted to engage the plug hole of one main frame bar of said bottom frame unit, a stop block disposed at the first end for sliding in the sliding slot of one main frame bar of said bottom frame unit, and a springy strip cut from a part of one sidewall of the second end, the spring strip of each auxiliary frame bar of said bottom frame unit having a free end terminating in a raised retaining portion for positioning in one of the locating holes of one main frame bar of said bottom frame unit; and a plurality of C-shaped clamps adapted to secure a garbage bag to the support frame bars of said support frame unit, said C-shaped clamps each a grained inner engagement wall.

* * * * *